United States Patent [19]

Wang

[11] Patent Number: 4,758,196

[45] Date of Patent: Jul. 19, 1988

[54] BLOCK UNIT FOR MAKING THREE-DIMENSIONAL BLOCKS COMPOSED OF GEOMETRIC POINTS, LINES AND PLANES

[76] Inventor: Tsung-Hsien Wang, P.O. Box 10160, Taipei, Taiwan

[21] Appl. No.: 30,976

[22] Filed: Mar. 27, 1987

[51] Int. Cl.[4] ..... A63H 33/12; A63H 33/08

[52] U.S. Cl. ..... 446/104; 446/113; 446/117; 446/120; 446/126; 403/174; 403/171; 52/645

[58] Field of Search ..... 446/113, 114, 117, 126, 446/116, 120, 125, 124, 104, 108, 102, 111, 112, 85, 107; 434/211, 278, 403; 52/81, 109, 645; 403/174, 170, 178, 171, 176; D21/108

[56] References Cited

U.S. PATENT DOCUMENTS

| | | | |
|---|---|---|---|
| 1,707,691 | 4/1929 | Sweet | 446/126 |
| 2,633,662 | 4/1953 | Nelson | 446/114 |
| 2,701,152 | 2/1955 | Cutler | 446/120 X |
| 2,722,772 | 11/1955 | Steanes | 446/126 |
| 3,550,311 | 12/1970 | Fouquart | 446/120 X |
| 3,698,123 | 10/1972 | Heldt | 446/120 |
| 3,927,489 | 12/1975 | Bernstein | 446/124 X |
| 4,054,393 | 10/1977 | Talleri | 403/176 X |

FOREIGN PATENT DOCUMENTS

| | | | |
|---|---|---|---|
| 1183331 | 7/1959 | France | 446/125 |

*Primary Examiner*—Mickey Yu

[57] ABSTRACT

Construction units for forming multiple-faced polyhedrons and a wide variety of structural forms. The units are in the form of a circular disk and a link. The disk having concentric rings formed thereon, and further having a threaded female connector on one side and a male connector on the other side. The link is in the form of a ladder-shape having two end clamps for engagement with disk units and other link units.

3 Claims, 4 Drawing Sheets

BLOCK UNIT FOR MAKING THREE-DIMENSIONAL BLOCKS COMPOSED OF GEOMETRIC POINTS, LINES AND PLANES

BACKGROUND OF THE INVENTION

Charles O. Perry disclosed Rhombic Hexahedra Blocks for making Rhombic Dodecahedra in his U.S. Pat. No. 3,611,620, in which geometric toy blocks can be made by fitting four obtuse hexahedra together to have geometric shapes, and however have the following defects:

1. Even many shapes of geometric polyhedra can be assembled by assembling several individual polyhedron units different from each other. The production cost for modling the basic units such as cubical hexahedron, rhombic hexahedron or other shapes will be increased.

2. Every two neighboring blocks are coupled by pair of stems and spherical end portions. The stems as fixed inside each block may increase their production complexity and each stem may be broken or damaged after repeated services.

3. It is difficult to assembly an irregularly shaped toy bokcs such as to mimic an animal, a machine or an article since they are lacking of linear linking elements or rotating elements, so that it is difficult to form diversified vivid gigantic structures.

The present invention has found the defects of such a conventional blocks and invented the present block unit for making three dimensional blocks.

SUMMARY OF THE INVENTION

The object of the present invention is to provide a block unit comprising a circular disk means and a ladder-shaped link means wherein each circular disk means may serve as a point or vertex and each link means may serve as a line section so that a diversified geometric polyhedron or an irregularly-shaped gigantic structure or skeleton can be assembled by assembling a plurality of the disk means and the link means to include geometric points, lines to vividly mimic the true articles or animals and enrich the player's interest.

DETAILED DESCRIPTION

Figure 1:
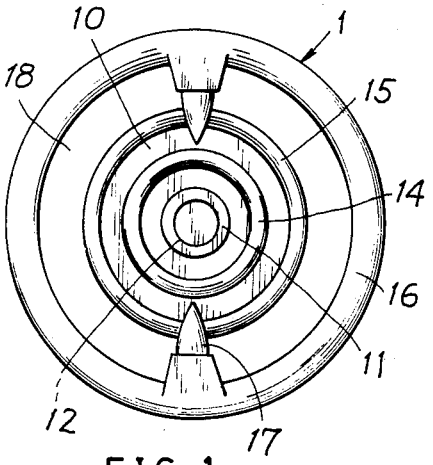
FIG. 1 is a top view of a circular disk means of the present invention.
Figure 2:
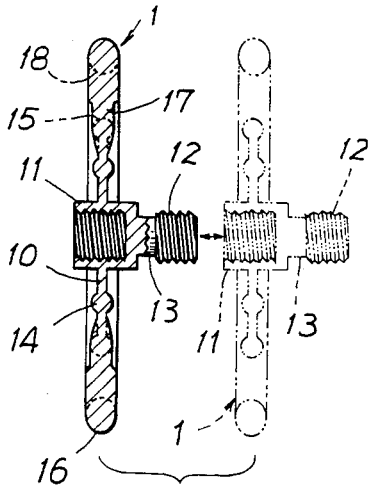
FIG. 2 is a sectional drawing showing a circular disk to be assembled with the other disk in accordance with the present invention.
Figure 3:
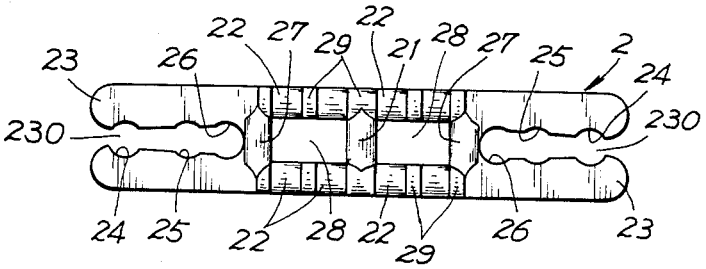
FIG. 3 is an illustration of a ladder-shaped link means of the present invention.

As shown in FIGS. 1–3, the block unit of the present invention comprises a circular disk means 1 and a ladder-shaped link means 2, each circular disk means 1 serving as a point or a vertex and each ladder-shaped link means 2 serving as a line section for a geometric shape.

Each circular disk means 1 includes an upper female socket 11 formed on a central portion of a central disk portion 10, a lower male screw 12 engageable with female socket 11 of another circular disk 1 and extending downwardly from the central disk portion 10 by a neck portion 13, an inner ring 14 concentric to the center of the central disk portion 10 and secured to the disk portion 10 and extending on both sides of the disk portion 10, a middle ring 15 concentric to the center of the disk portion 10 and extending on both upper and lower sides of the disk portion 10, an outer ring 16 concentric to the center of disk portion 10 outside the inner ring and spaced from the middle ring 15 by an annular groove 18 outside the middle ring and connected to the ring 15 by a pair of radial connectors 17 across the annular groove 18.

Each ladder-shaped link means 2 includes a pair of parallel longitudinal bars 22 transversely connected by a central bar 21 perpendicular to the two longitudinal bars 22 and also transversely connected by a pair of side bars 27 each bar 27 positioned on an outer side of the central bar 21 and perpendicular to the two bars 22, having a pair of side clamps 23 disposed on two opposite ends of the two side bars 37. Each side clamp 23 includes an outer notch 24, a middle notch 25 and an inner notch 26 inwardly subsequently formed along a slit 230 recessed from the outermost end of each clamp 23. A pair of intermediate windows 28 are formed on two opposite sides of the central bar 21 each window 28 defined by the two longitudinal bars 22, each side bar 27 and the central bar 21. On the intermediate surface of each longitudinal bar 22, there is formed with corrugations 29 to limit the longitudinal slipping of the assembled links.

Figure 4:
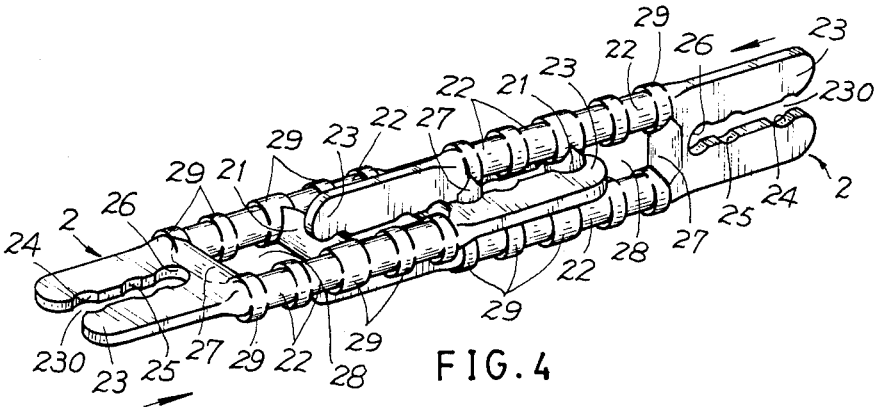
FIG. 4 is an illustration showing the assembly of a link means with the other link in accordance with the present invention.

In FIG. 4, one link means 2 is coupled to the other link 2 by coupling one outer notch 24 of the right link 2 with the other side bar 27 (as shown in dotted line) of the left link 2, and the right link 2 can be further pushed leftwards to deeply couple the left link 2 until the inner notch 26 of the right link 2 engaging with the right side bar 27 of left link 2 (full line). Plural links 2 can be linearly assembled to form a geometric line or line section.

Figure 5:
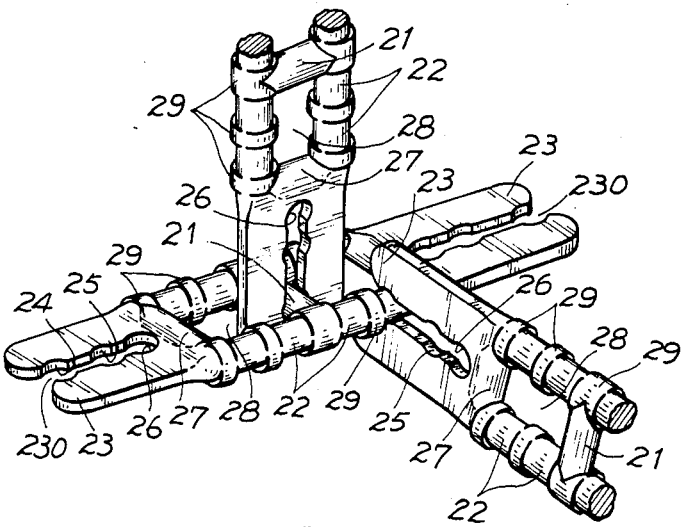
FIG. 5 shows still another application for the assembly of several link means of the present invention.

In FIG. 5, other styles for assembling the links 2 can be optionally done to form diversified geometric structure or skeleton. Any notch of the link 2 should be able to engage with either central bar 21, or side bar 27 or longitudinal bar 22 in any direction of other link.

Figure 6:
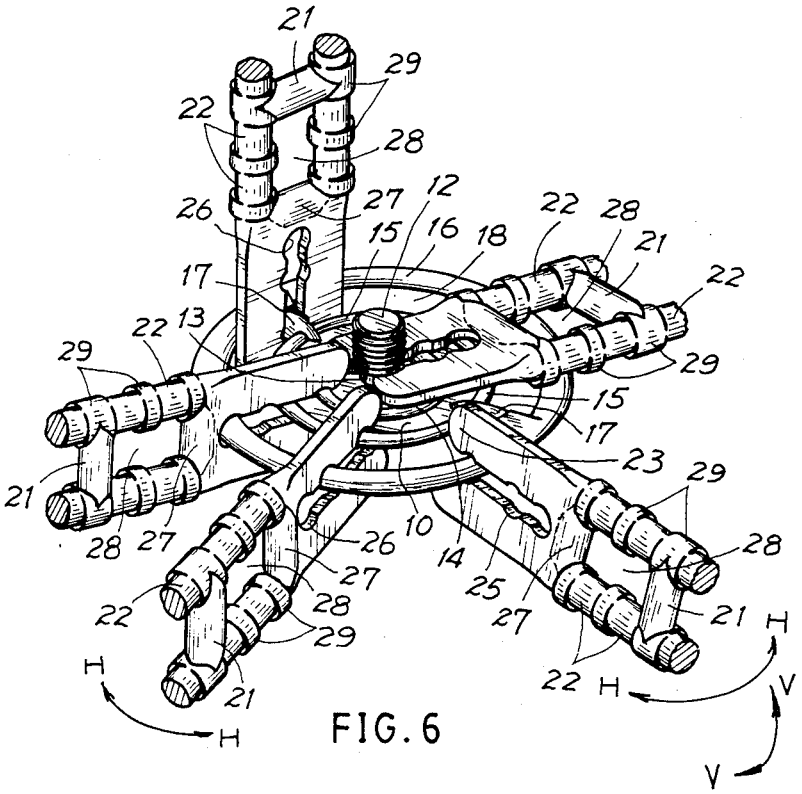
FIG. 6 shows the assembly of link means on a circular means of the present invention.

In FIG. 6, one link 2 can be coupled to the circular disk 1 by engaging the notch 24 or 25 or 26 of the link 2 with the neck portion 13 of the circular disk 1. Another link 2 can be coupled to the radial connector 17 of the circular disk 1. Any notch 24 or 25 or 26 of the link 2 can be engaged with either ring 16 or 15 or 14 for circular movement of each link 2 along the perimeter of each ring. On the outer ring 16, the link 2 having its outer notch 24 engaged with the ring 16 can be either horizontally moved along the ring perimeter (H) or verically moved (V) along the intersection of the ring 16.

From the aforementioned, the length of the slit 230 of each link clamp 23 should be long enough to allow all notches 24, 25, 26 operatively engaged with each ring 16 or 15 or 14 of the disk means 1, and should also be long enough so that one inner notch 26 of one link 2 may be deeply engaged with one side arm 27 of the other link 2.

Figure 7:
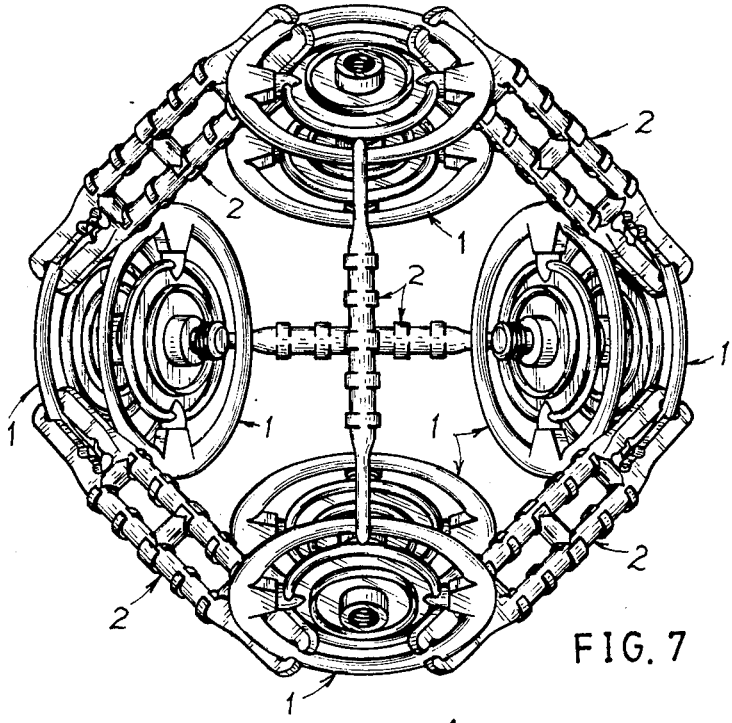
FIG. 7 shows a geometric tetrahedron assembled in accordance with the present invention.

By using each disk means 1 as a vertex and each link means 2 as a line section, a geometric shape of a tetrahedron can be assembled as shown in FIG. 7. By the way, other polyhedra such as: six-faced, 8-faced, 12-faced, 20-faced, and other multiple-faced polyhedron can be easily assembled. In FIG. 7 two circular disk means 1 can be overlain together to frictionally pressurize the neighbor link means 1 for stable construction of geometric shape. The coupling of two disks 1 can be adjusted for diversified geometric polyhedra.

Figure 8:
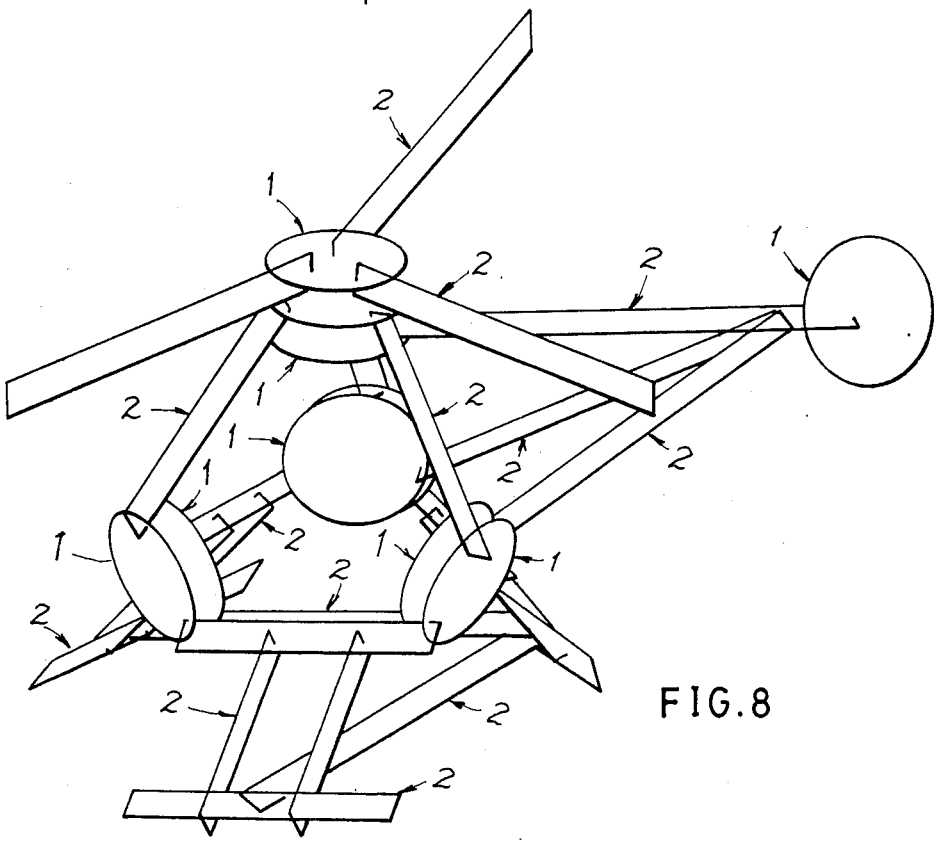
FIG. 8 shows a helicopter assembled in accordance with the present invention.
Figure 10:
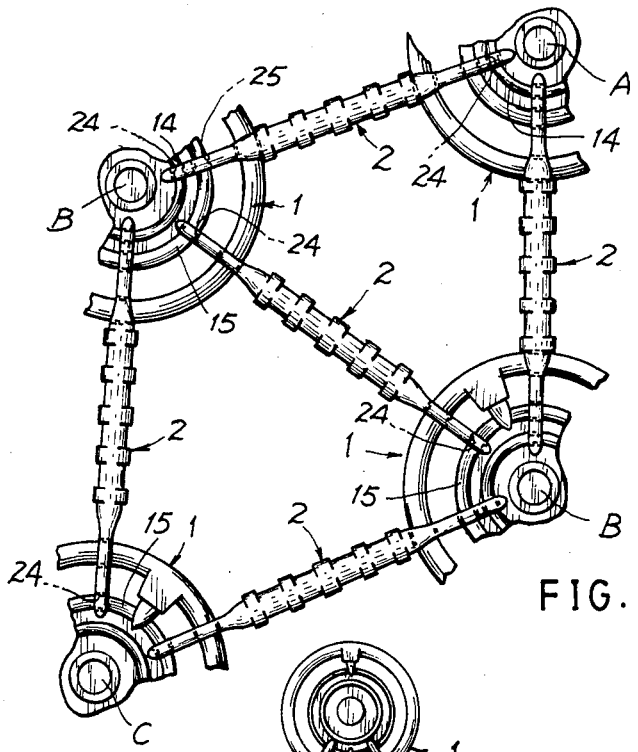
FIG. 10 is a partially enlarged illustration showing the assembly of a star plane as shown in FIG. 9.

In FIG. 8, an irregularly-shaped skeleton such as a helicopter can be assembled in which the cabin of the helicopter is composed of a tetrahedron by plural circular disk means 1 and plural link means 2, the rotor blades are formed by engaging three linear assemblies each having three link means 2 fixed on a central circular disk means 1, and the tailrotor is formed by a circular disk means 1 rotatably mounted on a link means 2 which is then secured to the tetrahedron cabin by several linear arrangement of link means 2.

Figure 9:
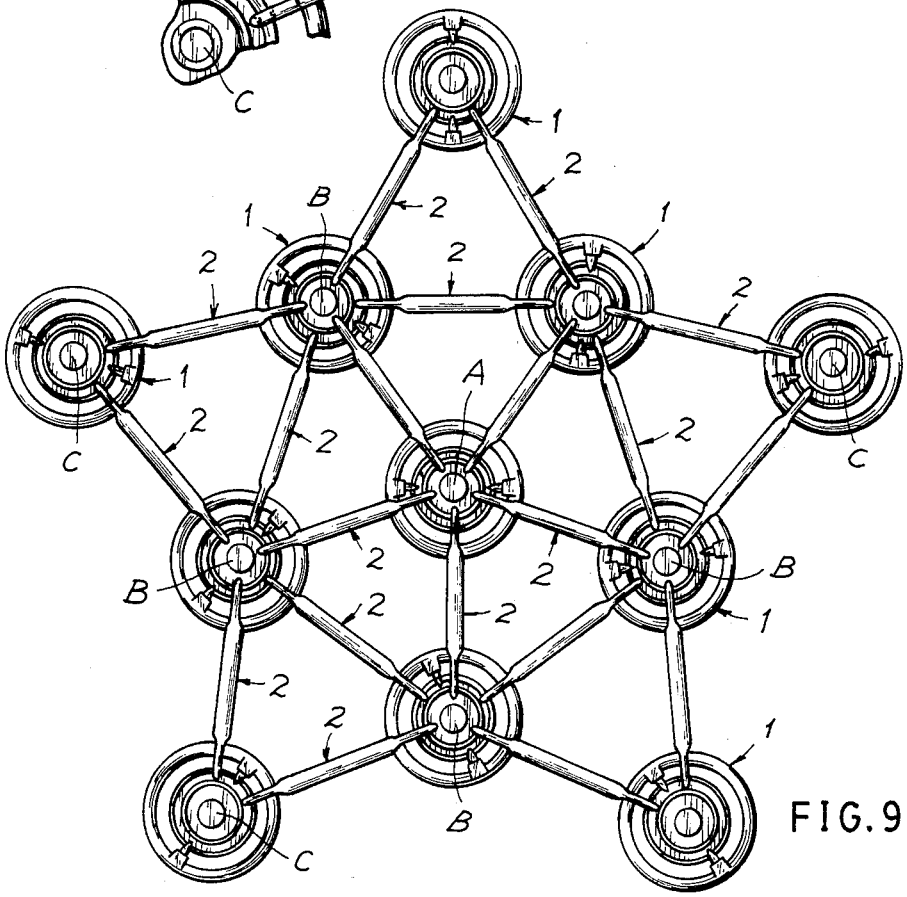
FIG. 9 shows a star-like plane assembled in accordance with the present invention.

As shown in FIG. 9, a star-like plane is formed by assembling plural circular disk means 1 and plural link means 2. Since the link 2 can be optionally engaged with either ring 16 or 15 or 14 of the circular disk 1, the distance between every two neighboring points (circular disk 1) can be conveniently adjusted for smoother connection of the two neighboring circular disks 1. For instance, the center point A is connected to middle point B by a link 2 having the notch 24 of its inner end connected with ring 14 of point A and having the other notch 24 of the outer end connected to ring 14 of point B. Between point B with another point B, the connecting link 2 has its left-end notch 24 connected with the ring 15 of left point B and has its right-end notch 24 connected with the ring 15 of right point B. The link 2, used to connect point B with point C, has its outer notch 24 connected with ring 14 of point B and has its outer notch 24 of the other link end engaged with the other ring 15 of point C.

The present invention has advantages superior to conventional geometric blocks such as:

1. Each link 2 can be horizontally or vertically rotated along the circular disk 1 to diversify the assembled angles or orientations to easily assembly a compelx geometric shapes or irregular gigantic skeleton so as to vividly form or mimic an article, animal, a machine or other structures for teaching aids, interesting play or decorative uses.

2. Only two basic units are required, i.e. a circular disk and a link to thereby reduce production cost of the blocks.

3. The basic unit includes only two basic elements which can be easily assembled or played regardless of player's age.

I claim:

1. A construction set for making three dimensional structures of the type having geometric points or vertexes and lines composed of circular disk means serving as the geometric points or vertexes and ladder-shaped link means serving as the lines, the improvement comprises:

at least one circular disk means comprising a central disk portion having two sides and a female socked formed on one side and at a center thereof, a male screw extending from the other side and at the center thereof and is secured to said central disk portion by a neck portion, said screw is adapted to be removably engageable with the female socket of another identical circular disk means, an inner ring extending on said two sides of said central disk portion and being concentric to the center thereof, a middle ring extending on said two sides of said central disk portion and being concentric to and equally spaced from said inner ring, and an outer ring concentric to and equally spaced from said middle ring by an annular slot through opening and is secured to said middle ring by a pair of radial connectors across said opening; and at least one ladder-shaped link means comprising a pair of spaced parallel longitudinal bars transversely connected by a central bar perpendicular to said longitudinal bars, a pair of side bars transversely connected to said longitudinal bars and being equally spaced one on each side of said central bar forming respective intermediate windows defined by said longitudinal bars, said central bar and said side bars, a pair of side clamps disposed one on each opposite end of said link means, each of said clamps having a slit open at one end thereof, and an outer notch, a middle notch and an inner notch sequentially formed along said slit, said slit adapted to be removably engageable with said outer ring, middle ring, inner ring, neck portion, and radial connector of said circular disk means, and adapted to be removably engageable with a central bar, a side bar, and a longitudinal bar of another identical ladder-shaped link means, and said outer notch adapted to be removably engageable with said outer ring for a pivotal and a sliding movement along said outer ring of said circular disk means.

2. A construction set according to claim 1, wherein at least one of said longitudinal bars is formed with corrugations on an intermediate surface thereof to limit a longitudinal slipping of a link means when assembled.

3. A construction set according to claim 1, wherein a plurality of said circular disk means and a plurality of said link means are assembled in the form of a multiple-face polyhedron.

* * * * *